United States Patent [19]

Barber

[11] 4,312,453

[45] Jan. 26, 1982

[54] FILE HANGING SYSTEM

[75] Inventor: Donald T. Barber, Toronto, Canada

[73] Assignee: Datafile Limited, Willowdale, Canada

[21] Appl. No.: 71,549

[22] Filed: Aug. 31, 1979

[51] Int. Cl.[3] ..... A47F 7/16

[52] U.S. Cl. ..... 211/46; 211/162; 312/184

[58] Field of Search ..... 211/46, 123, 47, 162, 211/126; 312/183, 184, 189, 193; 402/4

[56] References Cited

U.S. PATENT DOCUMENTS

| | | | |
|---|---|---|---|
| 3,606,948 | 9/1971 | Strang | 211/162 X |
| 3,913,995 | 10/1975 | Malcik | 211/46 X |
| 3,994,547 | 11/1976 | Sitler | 312/184 |
| 4,008,807 | 2/1977 | Phillips | 211/162 X |
| 4,056,296 | 11/1977 | Hedstrom | 312/183 X |
| 4,155,607 | 5/1979 | Sitler | 211/46 X |
| 4,182,532 | 7/1980 | Walker | 211/162 X |

FOREIGN PATENT DOCUMENTS

| | | | |
|---|---|---|---|
| 1129473 | 1/1957 | France | 312/184 |
| 172641 | 9/1960 | Sweden | 312/184 |

*Primary Examiner*—J. Franklin Foss

[57] ABSTRACT

According to the present invention, a file hanging system consists of a file edge backing means provided with a T-shaped member and bracket means provided with a U-shaped groove for engaging the T-shaped member, the arrangement is such that when the T-shaped member is inserted in the U-shaped groove, the weight of the file on which the backing edge is secured, moves the T-shaped member to a locking engagement in the groove, regardless of its direction of its insertion.

9 Claims, 10 Drawing Figures

10
11
11a
13
15
17
19
25
26
27
29
31
33
35
37
39
F

FILE HANGING SYSTEM

FIELD OF THE INVENTION

The present invention relates to a file hanging system in which a supporting bracket and a file edge backing are adapted to co-operate with one another for hanging a file to which the backing is secured.

BACKGROUND OF THE INVENTION

Conventional file hanging systems are generally of the type in which a hook is provided at each end of the file for hanging the file from a pair of supporting rods or bars. Typical arrangements are shown in U.S. Pat. Nos. 3,667,854 issued June 6, 1972 to F. D. Jonas and 3,779,393 issued Dec. 18, 1973 to Carl E. Grundell.

Filing systems such as those described above, can be very awkward to work with. The files on which they are used are not, as a general rule, readily accessible or suitable for use in a covered filing cabinet because the files must be dropped into hanging positions from above the supporting rods. Furthermore, the use of a pair of supporting rods takes up significant office space which might be otherwise used.

As an alternative, arrangements such as those shown in U.S. Pat. Nos. 3,980,360 issued Sept. 14, 1976 to Wright et al and 4,056,296 issued Nov. 1, 1977 to Hedstrom et al; have been provided with a securing hook for use in hanging the file. These arrangements are somewhat better than those described above, in that only a single supporting bracket is required and the file is mounted from the side of the bracket as opposed to from above the bracket. However because of the shaping of the hook member, and its sunken location, manipulation of the file is still required to get the hook on and off the supporting rod. Furthermore, because the hook is open at one side only, the file must be turned in the proper direction prior to hanging it from the supporting rod which can be difficult when working in a crowded area.

The file hanging system of the present invention has been designed to overcome the drawbacks of the prior art in that it is not only extremely easy to use but also, requires very little filing space. The invention consists of file edge backing means which is secured on the edge of a file and a supporting bracket means. The bracket means has at least one U-shaped groove for engaging a T-shaped member provided on the backing means. The arrangement is one in which the T-shaped member is easily inserted in the U-shaped groove and the weight of the file to which the file edge backing means is secured automatically moves the T-shaped member to a locking engagement in the U-shaped groove regardless of which way the file is turned and the direction of insertion of the T-shaped member in the groove.

The file hanging system of the present invention can be used to hang files in both the vertical and the horizontal direction. In the former case, which is used for pricing binders and the like, the bracket means is turned so that the U-shaped groove is open from above and the T-shaped member is simply dropped into the groove where the weight of the file locks it in place. The bracket may be angled with respect to the vertical such that the file is tilted slightly rearwardly from bottom to top.

In an arrangement where the files are hung in the horizontal direction, the bracket is turned such that the U-shaped groove is horizontally disposed. The T-shaped member is positioned such that its main upright stem portion is secured at the midpoint of the file edge backing means with the ends of its cross portion extending to either side of the midpoint whereby, regardless of the T-member's direction of insertion into the U-shaped groove a file to which the backing is secured is supported offset from its centre of gravity. The resulting imbalance in the file weight moves the T-shaped member to a locking engagement in the groove.

Since there are no complicated hook arrangements and the like involved, the file is not only extremely easy to locate in the proper position for hanging, but is also very easy to remove from the hanging position. The automatic self-locking feature of the present invention makes what would appear to be an otherwise unacceptable U-groove and T-member arrangement extremely functional and easy to work with.

BRIEF DISCUSSION OF THE DRAWINGS

The above, as well as other features and advantages of the present invention will be described in greater detail according to the preferred embodiments of the present invention wherein.

Figures 3, 3A, 3B:
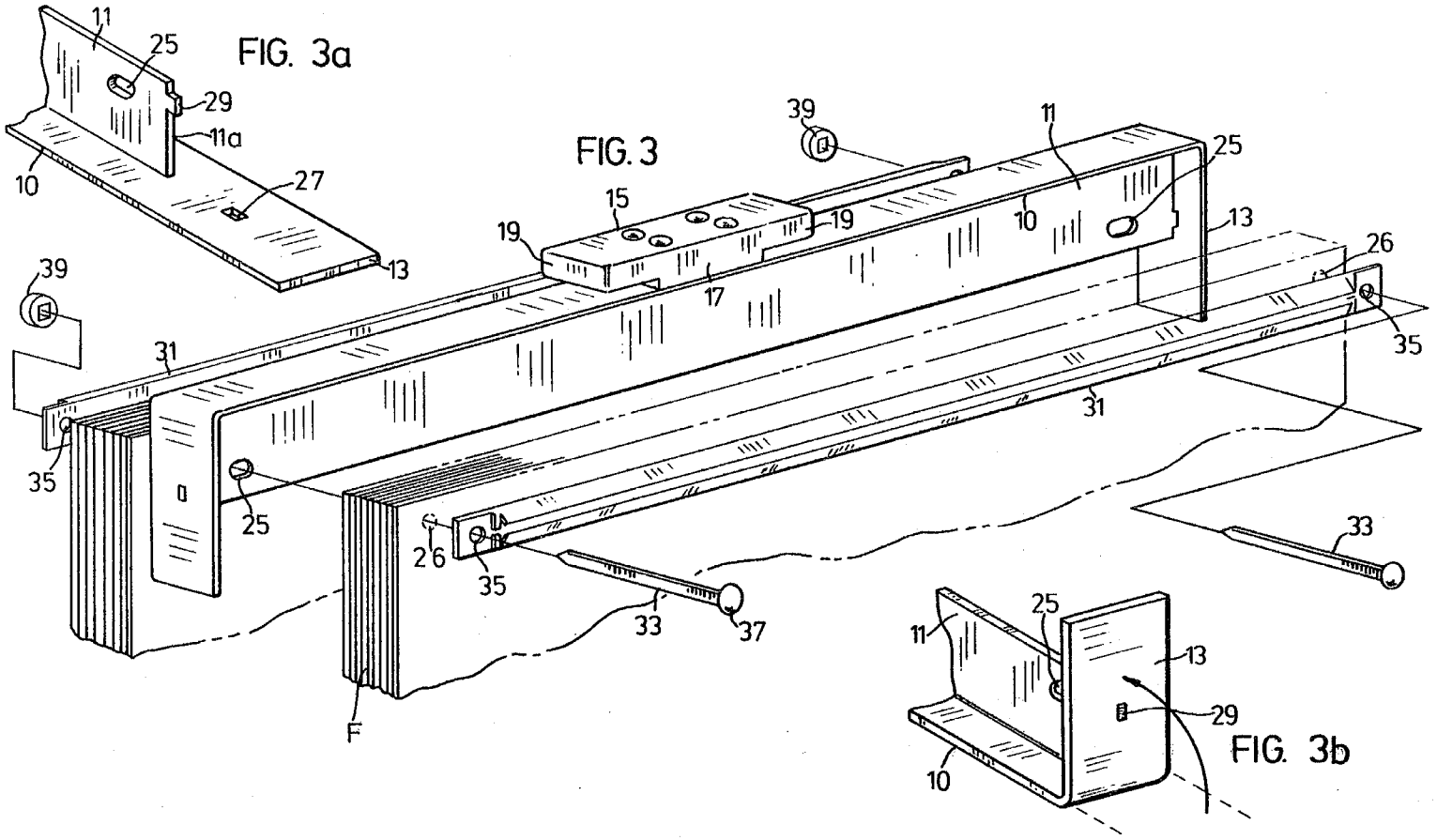
FIG. 3 is an exploded view of a file backing means according to an embodiment of the present invention used in conjunction with a file binding system.

FIG. 3*a* shows one end of the file edge backing means of FIG. 3 prior to assembly.

FIG. 3*b* shows the end of the file edge backing of FIG. 3 when assembled.

Figure 1:
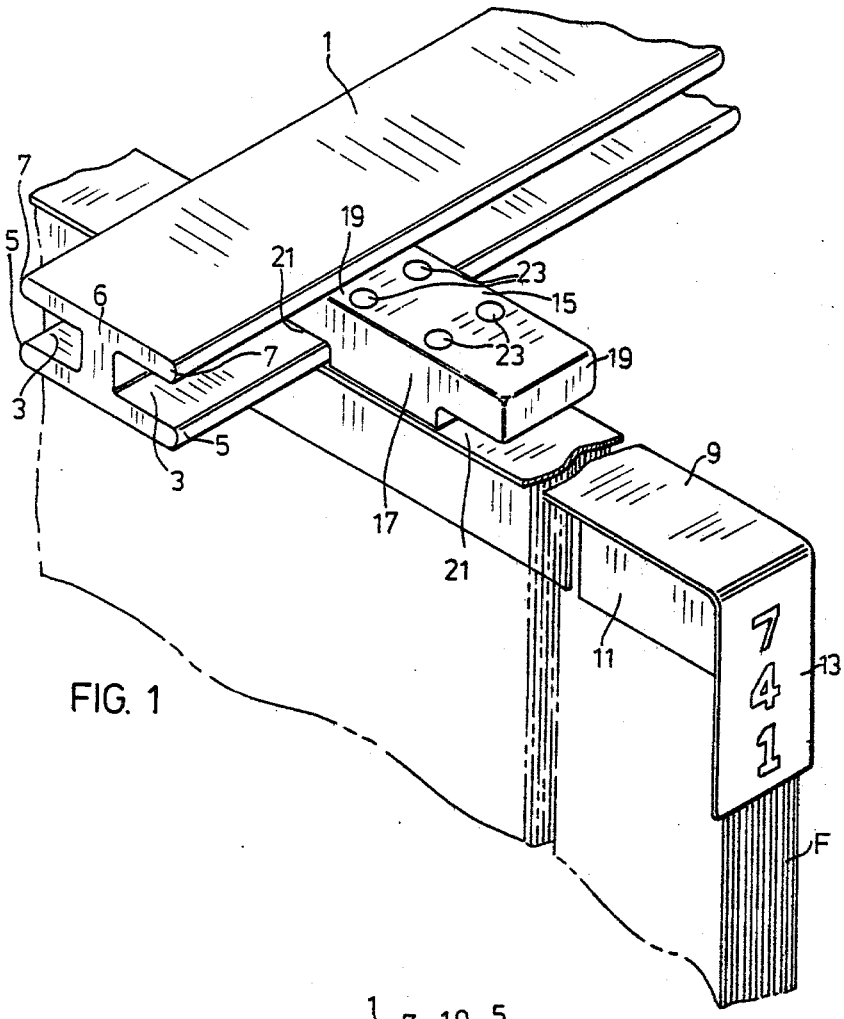
FIG. 1 is a perspective view looking down on a preferred arrangement of a file hanging system according to the present invention.
Figure 2:
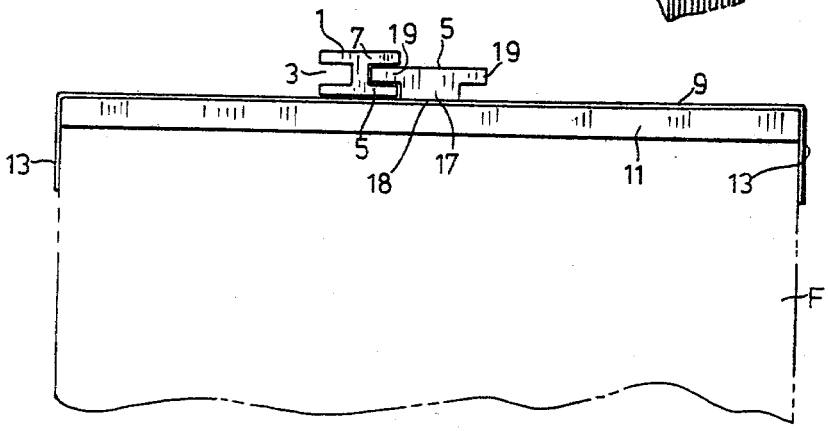
FIG. 2 is a side view of the arrangement shown in FIG. 1.
Figure 4:
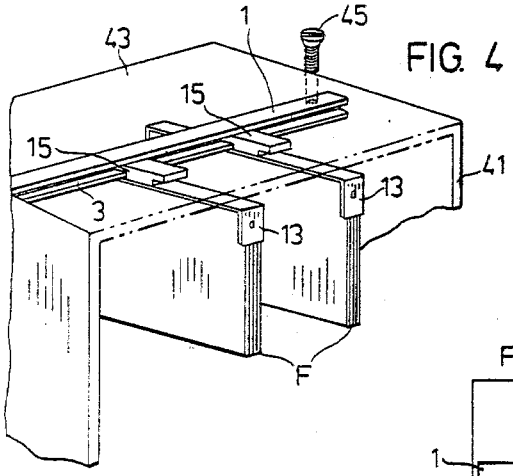

FIG. 4 is a perspective view looking down through a covered filing cabinet employing the file hanging system of FIGS. 1 and 2.

Figure 5:
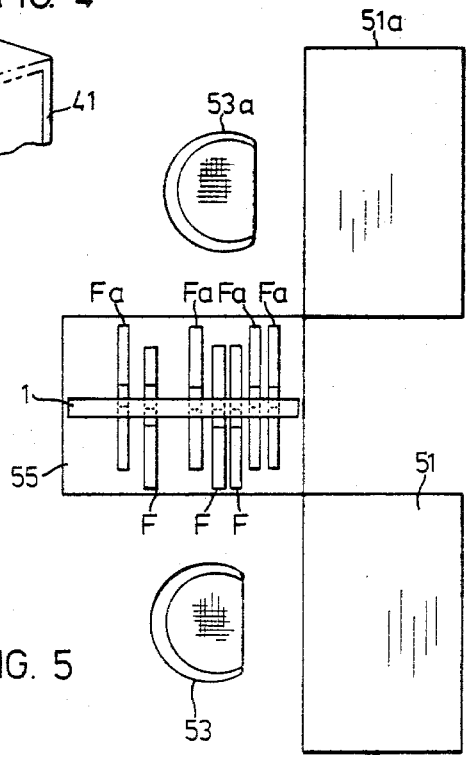

FIG. 5 is a top view looking down on a file hanging system as shown in FIGS. 1 and 2 wherein files are hung from either side of the supporting bracket.

Figure 6:
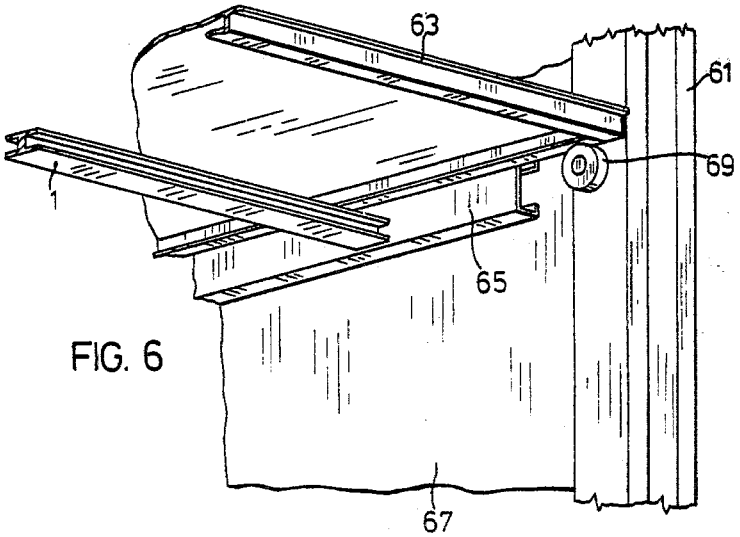

FIG. 6 is a perspective view showing a preferred form of a supporting bracket according to the present invention in a different type of closed cabinet from that shown in FIGS. 4 and 5.

Figure 7:
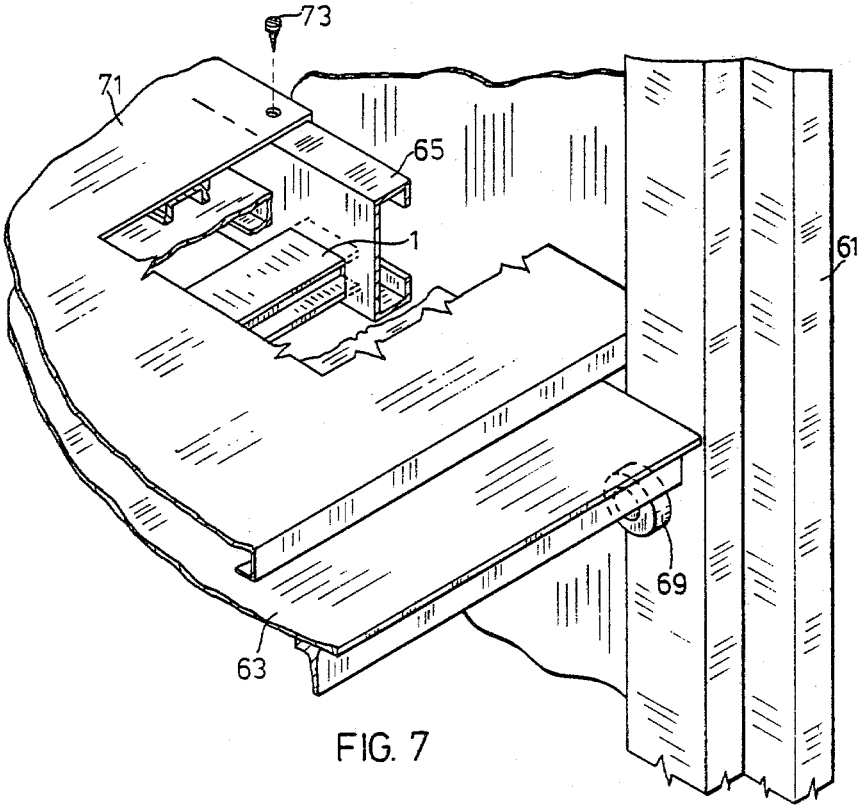

FIG. 7 is a partially cut-away perspective view looking down on the cabinet system shown in FIG. 6.

Figure 8:
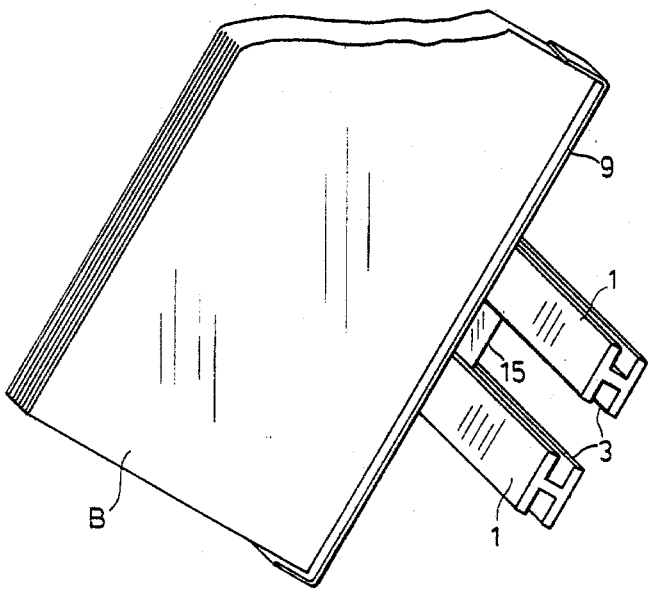

FIG. 8 shows an alternate arrangement for hanging a file according to the present invention from that shown in FIGS. 1 and 2.

DETAILED DESCRIPTION ACCORDING TO THE PREFERRED EMBODIMENTS

According to FIGS. 1 and 2, which show a file hanging in the horizontally disposed direction, the file hanging system includes a file backing member 9 provided along the edge of a file F and suspended from a supporting bracket 1. In this preferred arrangement, the bracket is provided with a pair of U-shaped grooves 3, one on either side of the bracket. The grooves are bounded by upper flange 7, lower flange 5 and central bracket portion 6. As will be seen from the drawings, the U-shaped grooves open in opposing directions.

File edge backing member 9 is provided on its upper surface with a T-shaped member 15. The T-shaped member includes a central, upright or stem portion 17. At the upper end of the stem portion extend the ends 19 of the cross portion of the T-member. Studs 23 secure the T-member to the file edge backing 9. As is best shown in FIG. 2, the upright portion of the T-member is centered on the mid-point 18 of the backing with cross portion ends 19 extending to either side of the midpoint and aligned with flange 10 of the backing means.

The file edge backing is also provided with rib portion 11, extending downwardly from the main flange 10. This rib portion is inserted directly into the file edge, to secure the backing in place as will be more fully explained with reference to FIG. 3. In addition, rib 11 provides rigidity and support to the backing member.

FIGS. 3*a* and 3*b* shown in greater detail, the end construction of the backing member. Rib 11 is provided at its outer end 11*a* with a projecting lug 29. Flange end portion 13 which prior to assembly extends beyond the rib as shown in FIG. 3*a*, is provided with a receiving aperture 27. This flange end portion is then bent downwardly and pressed against rib end 11*a* with stud 29 fitted in aperture 27. Finally, the stud is flattened to provide a permanent locking arrangement wherein, end portions 13 wrap around the edge of the file. These wrap around end portions not only provide protection at the corner of the file where the file papers would otherwise be subject to fraying and bending but in addition, provide a surface for the application of a file code, such as that shown in FIG. 1. With the horizontally hanging file arrangement the code is immediately apparent at the exposed edge of the file, for easy file identification to anyone looking through the filing system for a specific file.

To see exactly how the file edge backing is secured along the file edge, reference is made to FIG. 3 which additionally shows the use of file edge binding means. The file, generally indicated at F is formed by a plurality of papers such as looseleaf papers or printout sheets, and the like, through which openings 26 have been provided. The rib portion 11 of the file edge backing is fitted between the file papers, preferably somewhere near the center of the file, and the file edge is forced against the bottom side of flange 10 with end portions 13 overlapping the corner of the file as described above. It is to be understood that the file edge backing can be cut to any desired length to accommodate the length of the particular file to which it is secured.

The binding system used in conjunction with the backing consists of a pair of rigid support members 31 and securing fasteners 33. The rigid support members are placed at the file edge as shown in FIG. 3 with their end portions apertures at 35 and aligned with the openings 26 through the file. In addition, to these apertures, the downwardly depending rib of the backing member itself is apertured as shown at 25 and these apertures are also in alignment with openings 26 and apertures 35. The entire arrangement is then bound together by means of fasteners 37 which are fitted through the binding system, the file papers and the backing and secured by locking members 39. These locking members are fitted over the exposed ends of the fasteners and locked in place by a tooth and groove arrangement provided on the exterior of the fastener and the interior of the locking member which makes it easy to fully tighten the support members along the file edge so as to bind the file with the backing member secured in place.

The file is hung from the supporting bracket as shown in FIGS. 1 and 2. Depending upon which direction one wishes to hang the file, one of the ends 19 of the cross portion of the T-shaped member is fitted into one of the U-shaped grooves provided in bracket 1. It will be noted that the file can be turned through 180° and hung by the other end of the T-member cross portion if desired. Since the T-member extends upwardly from the file edge backing to an exposed position and because of its unique locking arrangement which will be described later in detail. Very little, if any, manipulation of the T-shaped member is required to fully locate it in place which is highly advantageous over the conventional hook arrangements particularly when working with a heavy file or in a crowded filing area.

Initially, it would appear that the simple combination of a U-shaped groove and T-shaped member would not be capable of holding the file in place in the horizontally disposed direction in the absence of a hook member as shown in the prior art. However, the unique construction of the present invention unexpectedly, and effectively, prevents the T-shaped member from falling out of the U-shaped groove and at the same time permits its sliding along the groove.

These features of the invention result from the positioning of the T-shaped member on the file edge backing. As is best shown in FIG. 2, the point of support for the file where the U-shaped groove engages the T-member is offset or to one side of the midpoint 18 of the file edge backing means which results in a file imbalance and moves the T-member to a locking engagement in the U-groove. According to FIG. 2, the center of gravity of the file is located to the right of the supporting bracket such that the file pivots slightly in the clockwise direction, forcing the secured end of the T-member, up against the bottom side of the flange portion 7. At the same time, the upper surface of the backing flange 10 is forced into contact with the base of bracket flange 5. The pivoting movement of the file is limited due to the close tolerances between the T-member and the U-groove so that the coefficients of friction between all of the contacting surfaces, is more than adequate to prevent the T-member from falling out of the groove. Furthermore, additional weight in the file, i.e., a larger file has the added effect of providing increased frictional contact so that regardless of the file weight, it is maintained in the secured locking position.

Not only is the file extremely easy to hang but in addition, it is easily retrieved from the system, by simply pulling on the file in the horizontal direction to overcome the frictional contacts described above. Therefore, unlike conventional hook arrangements, no significant lifting and maneuvering of the file out of a hook engaging position is required to release it from the bracket.

It will be readily understood from an analysis of the drawings that the locking principles described above, apply regardless of the direction of insertion of the T-member into the U-shaped groove. In other words, the file can hang by either of the ends 9 of the T-member cross portion. This feature again results from the positioning of the symmetrical T-member on the file edge backing so that the file imbalance required to lock the T-member in the U-groove is always present, regardless of which direction it is inserted into the grooves.

The file hanging system described with respect to FIGS. 1 and 2, is particularly suited to filing cabinets closed from above and open to the sides, as shown in FIG. 4. In this arrangement, bracket 1 is secured to the underside of the cabinet top 43 by means of securing bolts or screws 45. Cabinet 41 is open from its side where the hanging files F are fully accessible. The coded backing ends 13 are readily apparent to anyone using the filing cabinet. Should further files be added to the cabinet, they are quickly and easily inserted in place, and if required, the files presently in the cabinet are slid along supporting bracket 1 to make room for the additional files.

A further type of filing cabinet is shown in FIGS. 6 and 7 of the drawings. This cabinet is again used for the horizontal type of filing system of FIGS. 1 and 2.

Cabinet 61 may include a plurality of vertical shelving units 71, enclosed at the ends by endwalls 67 and accessible from the sides through sliding door 63. A support beam 65 is mounted to each of the endwalls and is cut out to receive an end of supporting bracket 1 as best shown in FIG. 7. This same arrangement is used in each of the shelf compartments of the filing cabinet. Rollers 69 around which sliding door 63 pivots, are provided adjacent the open side of the cabinet. As the door is pulled outwardly, it rolls over and pivots around rollers 69 to close off the open side of the cabinet and to cover any files hanging in the cabinet.

The feature of the present invention described above with respect to use of either of the ends of the cross portion of the T-member for hanging the file, is particularly desirable when working with a filing system arrangement as shown in FIG. 5 of the drawings. This arrangement takes advantage of not only the symmetrical shape of the T-member but also takes advantage of the symmetry of the H-shaped supporting bracket with its opposing U-grooves 3. This system which cannot be achieved through the use of conventional file hanging arrangements is one in which files F and Fa are hung on either side of bracket 1 and accessible to persons occupying chairs 53 and 53*a* respectively. Filing cabinet 55 in which supporting bracket 1 is secured is open from both sides so that an individual for instance, sitting in chair 53 and working at desk 51 can easily gain access to files F. On the otherhand, an individual working at desk 51*a* need only to turn his chair or reach over and select anyone of the files Fa which he or she, desires to work on. Moreover, because of the direction in which the files extend, it is readily apparent which files are hung on which side of the rack; i.e. files F extend toward chair 53 while files Fa extend towards chair 53*a*. Should the individual working on one of the files F complete that file he can then pass it over to the individual working on files Fa. The file can quickly and easily be hung on the other side of the bracket to form part of the group of files Fa. The same situation applies for any of the files Fa, which completed for passover to the individual working on files F, by virtue of the fact that the T-shaped member is not limited in its direction of insertion in the double grooved bracket.

It should again, be noted that even with this double opensided cabinet arrangement, the files are moved easily in and out of the filing cabinet.

FIG. 8 shows the use of the present invention in a vertical as opposed to a horizontal filing arrangement. Such an arrangement is commonly found with pricing binders and the like. The system includes an edge backing member 9 identical to that earlier described secured to binder B. Backing member 9 is provided with T-shaped member 15, the two cross portion ends of which are secured in the facing grooves 3 of aligned brackets 1. It will be noted that although the brackets are aligned, the upper of the two brackets is not directly above the lower bracket but it is shifted slightly so that the binder B is tilted rearwardly from top to bottom. This rearward tilting makes the binder easier to read from above and helps to keep the binder open at a certain desired page.

With this arrangement, the support for the binder is provided by the interlocking action between the lower supporting bracket and the downwardly facing end on the T-member so that the weight of the file, locks the two in place. The upper bracket which is not required to support the file is only used in cases where the binder is maintained at a relatively permanent location and prevents upward withdrawal of the T-member from the lower bracket. In the arrangement shown in FIG. 8, the binder is moved by sliding it along the facing grooves 3 of brackets 1.

As mentioned above, the upper bracket need not be present to support the pricing binder. In the arrangement shown in the drawings, the T-member is again located such that its center stem portion is secured centrally of backing 9 with the ends of the cross portion of the T-member extending to either side of the midpoint of the backing member. When the upper bracket is removed, the file imbalance again tends to move the T-member to a locking position in the U-groove of the bracket. If additional support for this arrangement is required, both the depth of the U-groove and the length of the T-member cross portion may be increased to add to the locking action. Furthermore, it should again be noted that if reversal of the file direction is required (for example, where the binder printed in two or more languages) then the combination of the T-shaped member and the U-shaped groove is usable regardless of the direction in which the T-member is inserted into the groove.

As will be clearly understood from the foregoing, the simplicity and ease of use of the present invention, make it a highly desirable arrangement for a plurality of different types of filing systems. For example, the file shown in FIGS. 1 and 2 can be used with the vertical filing system of FIG. 8 and vice versa. The system is economical from both a cost and a space requirement standpoint. Moreover, it lends itself to arrangements such as that shown in FIG. 5 which were previously not possible and this as well as other unexpected advantages come about, due to its novel construction and unique arrangement of components.

Although various preferred embodiments of the invention have been described herein in detail, it will be apparent to one skilled in the art that variations may be made thereto, without departing from the spirit of the invention or the scope of the appended claims.

The embodiments of the invention in which an exclusive property or privilege is claimed are defined as follows:

1. A file hanging system consisting of file edge backing means provided with a T-shaped member comprising a central column positioned at a point of balance on said file edge backing means and a pair of arms projecting outwardly in opposing directions from said central column and bracket means provided with a U-shaped groove for engaging either of the arms of said T-shaped member, the arrangement being such that when said T-shaped member is inserted in said U-shaped groove, the weight of a file on which said file edge backing means is secured moves the T-shaped member to a locking engagement in said U-shaped groove regardless of its direction of insertion into said bracket means.

2. A file hanging system consisting of file edge backing means provided with a T-shaped member comprising a column positioned generally centrally of said backing means and a pair of arms extending in opposite directions outwardly from said column and bracket means provided with a horizontally disposed U-shaped groove for engaging said T-shaped member, said T-shaped member being secured in an upright position, centrally of and aligned with said file edge backing means, the arrangement being such that when either of the arms of said T-shaped member is inserted in said U-shaped groove, a file to which said backing means is secured, is supported offset from its centre of gravity whereby, an imbalance in file weight moves the T-shaped member to a locking engagement in said U-shaped channel regardless of its direction of insertion.

3. A file hanging system as claimed in claim 2 wherein said bracket means has an H-shaped configuration and includes a pair of horizontally disposed U-shaped grooves, one on either side of said bracket and opening in opposing directions both of said grooves being adapted to receive either of said arms on said T-shaped member for supporting files on both sides of said bracket.

4. A file hanging system as claimed in claim 2, whereby the file imbalance moves the file to a position in which said file edge backing means, frictionally engages said bracket means and said T-shaped member is frictionally locked in said U-shaped groove.

5. A file hanging system as claimed in claim 1, for use in hanging the file in an essentially vertical position.

6. A file hanging system as claimed in claim 2, used for hanging the file in an essentially horizontal position.

7. A file hanging system as claimed in claim 1, wherein said file edge backing means, comprises a first horizontally disposed flange portion and a second vertically disposed flange portion, extending downwardly, centrally of the first flange portion for insertion in a file edge of the file secured to the file edge backing means.

8. A file hanging system as defined in claim 7, including downwardly, extending end portions formed by a downwardly bent continuation of said first flange portion and secured to said second flange portion for protecting the file edge.

9. A file hanging system as claimed in claim 1, wherein said T-shaped member extends upwardly from said file edge backing means.

* * * * *